US008210186B2

(12) United States Patent
Gueret

(10) Patent No.: US 8,210,186 B2
(45) Date of Patent: Jul. 3, 2012

(54) APPLICATOR FOR APPLYING A SUBSTANCE ONTO KERATINOUS FIBERS

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 320 days.

(21) Appl. No.: 10/721,552

(22) Filed: Nov. 25, 2003

(65) Prior Publication Data

US 2004/0134507 A1 Jul. 15, 2004

Related U.S. Application Data

(60) Provisional application No. 60/441,321, filed on Jan. 22, 2003.

(30) Foreign Application Priority Data

Nov. 27, 2002 (FR) ..... 02 14867

(51) Int. Cl.
*A45D 40/26* (2006.01)

(52) U.S. Cl. ..... 132/218

(58) Field of Classification Search ..... 132/218, 132/313; 15/206, 207; 401/122, 129
See application file for complete search history.

(56) References Cited

U.S. PATENT DOCUMENTS

| | | | | |
|---|---|---|---|---|
| 2,170,222 | A * | 8/1939 | Strauss | 604/2 |
| 3,343,551 | A * | 9/1967 | Anderson | 132/218 |
| 4,165,755 | A | 8/1979 | Cassai | |
| 4,428,388 | A * | 1/1984 | Cassai et al. | 132/218 |
| 4,617,948 | A * | 10/1986 | Gueret | 132/218 |
| 4,691,404 | A * | 9/1987 | Tarrson et al. | 15/167.1 |
| 4,861,179 | A | 8/1989 | Schrepf et al. | |
| 4,898,193 | A | 2/1990 | Gueret et al. | |
| 5,063,947 | A | 11/1991 | Gueret et al. | |
| 5,319,823 | A * | 6/1994 | Baum et al. | 15/160 |
| 5,328,282 | A * | 7/1994 | Charrier et al. | 401/4 |
| 5,391,011 | A * | 2/1995 | Gueret | 401/126 |
| 5,462,798 | A * | 10/1995 | Gueret | 428/364 |
| 5,525,452 | A | 6/1996 | Hopper et al. | |
| 5,918,994 | A * | 7/1999 | Gueret | 401/122 |
| 6,026,823 | A * | 2/2000 | Gueret | 132/218 |
| 6,220,254 | B1 | 4/2001 | Gueret | |
| 6,390,125 | B2 * | 5/2002 | Pawelzik et al. | 137/605 |
| 6,623,200 | B1 | 9/2003 | Gueret et al. | |
| 2002/0014250 | A1 | 2/2002 | Gueret | |
| 2002/0020426 | A1 | 2/2002 | Gueret | |
| 2002/0023657 | A1 | 2/2002 | Gueret | |
| 2002/0124860 | A1 | 9/2002 | Gueret | |
| 2003/0072602 | A1 | 4/2003 | Gueret | |

FOREIGN PATENT DOCUMENTS

| | | | |
|---|---|---|---|
| EP | 1053695 | A2 | 11/2000 |
| EP | 0832580 | B1 | 5/2001 |
| EP | 1236419 | A1 | 9/2002 |
| EP | 1236420 | A1 | 9/2002 |
| EP | 1236421 | A1 | 9/2002 |
| FR | 2749490 | A1 | 12/1997 |
| FR | 2798267 | A1 | 3/2001 |
| JP | 55-136409 | | 3/1979 |
| JP | 55-136409 | U | 9/1980 |
| JP | 60-113711 | U | 8/1985 |
| JP | 2-142213 | U | 12/1990 |

* cited by examiner

*Primary Examiner* — Rachel Steitz
(74) *Attorney, Agent, or Firm* — Oliff & Berridge, PLC

(57) ABSTRACT

An applicator for applying a substance onto the eyelashes or the eyebrows is disclosed. According to one embodiment, the applicator comprises a rod having an end extending along a longitudinal axis and a brush fixed to the end of the rod. The brush includes a core and bristles extending from a bristle-carrying portion of the core. Substantially all points of the bristle-carrying portion make a non-zero angle relative to the longitudinal axis that is less than about 20°.

29 Claims, 3 Drawing Sheets

APPLICATOR FOR APPLYING A SUBSTANCE ONTO KERATINOUS FIBERS

CROSS-REFERENCE TO RELATED APPLICATIONS

This application claims the benefit of U.S. Provisional Application No. 60/441,321 filed Jan. 22, 2003 and French Application No. 02 14867 filed on Nov. 27, 2002, the contents of which are hereby incorporated herein by reference.

BACKGROUND OF THE INVENTION

The present invention relates to applicators designed for applying a substance onto keratinous fibers, and in particular, the eyelashes or the eyebrows. The invention relates more particularly to an applicator comprising a rod having an end extending along a longitudinal axis, and a brush fixed to the end of the rod, the brush comprising a core and bristles extending from a bristle-carrying portion of the core.

Numerous applicators for applying substances to eyelashes or eyebrows are known. In particular, French patent application FR 2 798 267 describes an applicator in which the brush makes an angle relative to the rod so as to enable its free end to take substance from the walls of the receptacle containing the substance that is to be applied. In such an applicator, the angle formed relative to the longitudinal axis of the rod by the bristle-carrying portion of the core when said core is rectilinear, or by the tangent to the core at its distal end when said core is curved, is quite large. Other applicators comprising brushes having non-rectilinear cores are known from French patent application FR 2 749 490, and from European patent applications EP 0 832 580, EP 1 236 419, EP 1 236 420, and EP 1 236 421.

In certain applicators, the rod end of the brush of the bristle-carrying portion of the core makes quite a large angle, e.g. greater than 30°, relative to the longitudinal axis of the rod. With such a large angle, the brush cannot be used by the user without having firstly to identify the orientation of the core, thereby complicating the movements required to apply makeup.

SUMMARY OF THE INVENTION

One or more embodiment of the invention seeks to further improve applicators designed for applying make-up to the eyelashes and the eyebrows. In one embodiment, the invention provides an applicator comprising an applicator for applying a substance onto keratinous fibers, and in particular the eyelashes or the eyebrows. The applicator according to this embodiment comprises a rod having an end extending along a longitudinal axis; and a brush fixed to the end of the rod. The brush includes a core and bristles extending from a bristle-carrying portion of the core, wherein all points of said bristle-carrying portion making a non-zero angle relative to the longitudinal axis of the end of the rod that is less than about 20°.

According to one aspect, the bristles have free ends which define an envelope surface have a cross-section that is non-circular along at least one point. In another aspect, the bristle-carrying portion of the core may be rectilinear.

One or more embodiment of the invention provides an applicator in which the angle formed by the brush and the rod is quite small, and which may be used by the user without having firstly to identify the orientation of the core about the axis of the rod. Thus, the applicator may be used, where necessary, with substantially the same movements as with conventional applicators, in which the core extends in rectilinear manner entirely in alignment with the longitudinal axis of the end of the rod.

In addition, according to certain embodiments, when the cross-section of the envelope surface is non-circular along at least one point, the core does extend entirely in the alignment of the longitudinal axis of the end of the rod, and the envelope surface has a non-circular cross-section. In particular, the brush may be made with at least one longitudinal ridge, which, combined with the inclination of the core, can enable the bristles of the brush to penetrate better between the eyelashes in such a manner that the eyelashes can be combed and curled more easily and more effectively. Furthermore, while turning the applicator about the axis of the rod during application, it is possible to oscillate the brush, thereby enabling the bristles of the brush to grip the eyelashes more effectively.

The bristle-carrying portion of the core may form an angle, relative to the longitudinal axis of the end of the rod, which is less than about 20°, in particular, less than about 15°, and more particularly, less than or equal to about 10°, e.g. close to about 8°. The angle formed by the bristle-carrying portion of the core relative to the longitudinal axis of the rod may lie in the range about 0.2° to about 20°, and preferably in the range about 0.5° to about 15°, and more preferably in the range about 1°, or even about 5°, to about 10°.

The core may be substantially rectilinear at least along the bristle-carrying portion. When the core is not rectilinear, the angle at any point of the core relative to the longitudinal axis of the end of the rod is provided by the tangent to the longitudinal axis of the core at this point.

The distance between the end remote from the rod of the bristle-carrying portion of the core and the longitudinal axis X of the end of the rod depends on the length of the brush. In particular embodiments the distance may be less than about 7.5 millimeters (mm), or even less than about 4.5 mm for example, e.g. about 3 mm. The longitudinal axis of the bristle-carrying portion of the core may extend into a plane that also contains the longitudinal axis of the end of the rod. The brush may have an envelope surface having an oblong cross-section of major axis perpendicular to the above-mentioned plane. The above-mentioned cross-section may be lenticular in shape, for example.

By way of example, the brush may also have at least one face or facet that is perpendicular to said plane.

The longitudinal axis of the bristle-carrying portion of the core may extend entirely on the same side of a plane containing the longitudinal axis of the end of the rod. The end remote from the rod of said portion may constitute the furthest point of said portion from the longitudinal axis of the rod.

The brush may present at least one longitudinal ridge, and in a non-limiting example, the brush may include two to eight ridges, for example.

The brush may present at least one plane or concave face or facet. The brush may also present at least one convex face or facet, in particular having a radius of curvature, when the brush is observed in cross-section, that is greater than the length of the longest bristle extending from the core to said face or facet in said section.

The core may comprise at least two twisted-together strands, in particular two twisted-together metal strands, which may originate from folding a metal wire in half. The strands may be twisted together with a left-hand pitch, or in a variant, with a right-hand pitch.

The envelope surface may be of constant cross-section over most, or even all, of the length of the bristle-carrying portion of the core. The envelope surface may have at least one portion having a cross-section that varies, e.g. in size but not in shape. By way of example, the cross-section of the envelope surface, along at least one point of the core, may have a general shape selected from the following list: polygonal, in particular triangular, square, pentagonal, hexagonal, oblong, in particular oval, lenticular, star-shaped, in particular with three to six branches; or in the general shape of a keyhole.

For at least one cross-section of the envelope, the core may define the center of symmetry of said section. The core may also be off-center along at least one point along the length of the brush. The applicator may include at least two sets of bristles of different diameters. The applicator may include at least one set of bristles made of a resilient material, in particular an elastomer.

The applicator may include at least one set of bristles including a compound, e.g. a particulate compound or the like, making it easier for the bristles to slide over keratinous fibers, or, on the contrary, designed to create a coarse surface, thereby increasing the grip on keratinous fibers.

The applicator may include a blend of bristles. The applicator may comprise at least one bristle including at least one undulation, and may in particular comprise at least two bristles including each at least one periodic pattern including at least one undulation, at least two periodic patterns being different. The two periodic patterns may be part of two separate bristles or of a single bristle, and the waves may include different shapes, for example, may be serrated or sinusoidal, or may have various amplitudes or a wave of various spatial frequencies. The wording "periodic pattern" refers to a part of a bristle which is substantially repeated periodically along the bristles.

The applicator may comprise bristles other than made by injection molding with the core, and a brush may comprise at least one portion comprising curved bristles extending in an oriented manner from the core. By "extending in an oriented manner", it has to be understood that the curved bristles extend in a general orientation which is imparted during the manufacture of the brush and not with a totally random orientation. The bristles may in particular be oriented in the same circumferential direction around the core. The bristles of the brush may be curved by contact with a hot surface, in particular a surface movable with respect to the brush. The surface may, for example, be defined by a material having a relatively low thermal conductivity, for example a silicone, a fluorinated polymer, for example a polytetrafluoroethylen, or an inorganic material other than metal, in particular, graphite.

The applicator may comprise a twisted core defining single turns, the bristles being engaged between the turns of the brush, the brush comprising at least two bent bristles engaged between two adjacent single turns, some material being taken off from the bristles or the bristles having a flattening in at least a point of their length and the bristles extending non radially towards the outside from said point. Each bent bristle may comprise two rectilinear portions forming an angle between them. The two rectilinear portions may have the same transversal section. All the bent bristles may define bends all situated substantially at the same distance from the core.

The applicator may comprise between 5 and 80 bristles in a single turn, for example, between 10 and 50 bristles in a single turn. Alternatively, the brush may also have fewer bristles and comprise between 5 and 20 bristles by single turn. The number of bristles in a single turn corresponds to the number of free ends of bristles counted by a fixed observer during a 180° rotation of the brush around its core. The applicator may comprise twisted bristles.

In a non-limiting aspect of the invention, the rod is connected to a handle. The handle may be arranged in such a manner as to close, in sealed manner, a receptacle containing the substance to be applied, which receptacle may be provided with a wiper member.

In another embodiment, the invention also provides, independently or in combination with the above, an applicator for applying a substance onto keratinous fibers, and in particular the eyelashes or the eyebrows. According to this aspect, the applicator comprises a rod having an end extending along a longitudinal axis X and a brush fixed to the end of the rod, the brush including a core and bristles extending from a bristle-carrying portion of the core. The bristles have free ends which define an envelope surface, preferably of non-circular cross-section along at least one point. The rod end of the portion forms a non-zero angle relative to the longitudinal axis X, said portion presenting a distal end extending from mid-way along its length in the direction of the free end of the brush. The longitudinal axis X intersects the envelope surface of said distal end, said portion being further away from the longitudinal axis X at its end remote from the rod than at its middle.

In another embodiment, the invention also provides a packaging and applicator device for applying a substance onto keratinous fibers, in particular the eyelashes or the eyebrows. The device comprises a receptacle containing the substance, and an applicator as defined above. The device may further comprise a wiper disposed in such a manner as to wipe the brush while it is being removed from the receptacle.

BRIEF DESCRIPTION OF THE DRAWINGS

The present invention will be better understood on reading the following detailed description of non-limiting embodiments thereof, and on examining the accompanying drawings, in which.

DETAILED DESCRIPTION

Before describing several exemplary embodiments of the invention, it is to be understood that the invention is not limited to the details of construction or process steps set forth in the following description. The invention is capable of other embodiments and of being practiced or carried out in various ways.

Figure 1:
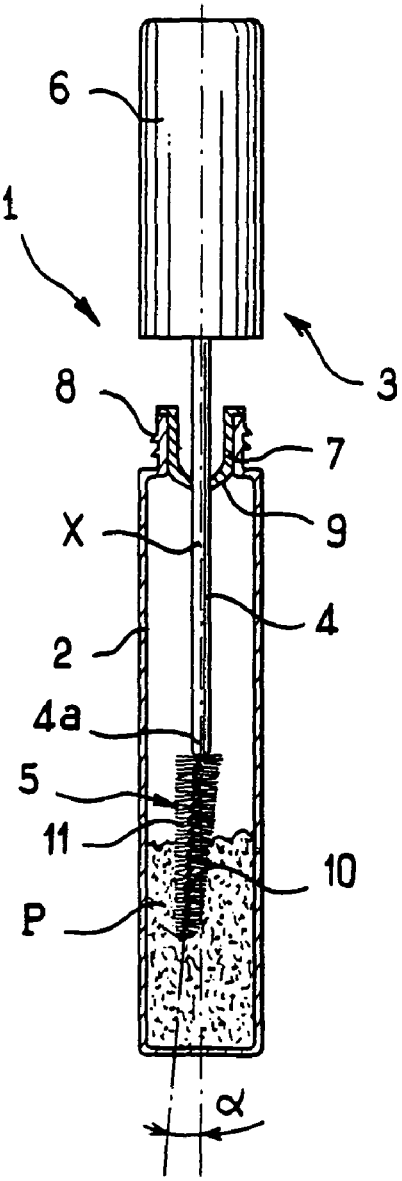
FIG. 1 is a side elevational view in partial axial section, of an example of a packaging and applicator device of the invention.

FIG. 1 shows a packaging and applicator device according to a first embodiment comprising a receptacle 2 containing a substance P to be applied to the eyelashes or the eyebrows (e.g. mascara) and an applicator 3 comprising a rod 4 of circular cross-section, provided at one end 4*a* with a brush 5, and fastened at its other end to a handle 6 also constituting a closure cap for the receptacle 2. The receptacle is fitted with a wiper member 7, e.g. constituted by an elastomer piece inserted into the neck 8 of the receptacle. Other types of wipers may be used.

In the example described, the rod 4 has a rectilinear longitudinal axis X which coincides with the axis of the neck 8 of the receptacle 2 when the applicator is in place in said receptacle. The handle 6 is arranged so as to close the receptacle 2 in a sealed manner when said handle is fully screwed onto the neck 8 in manner known to those skilled in the art. In the example shown, the wiper member 7 includes an orifice 9 of circular section, having a diameter that corresponds substantially to the diameter of the rod 4. The brush 5 has a core 10 formed of two twisted-together metal strands, said core 10 being fixed at one end in a housing of the rod 4, e.g. being force-fitted in said housing.

Figure 2:
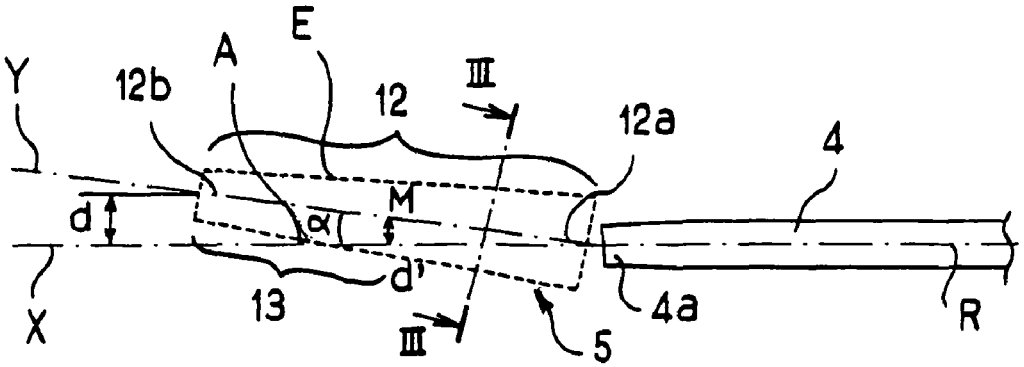
FIG. 2 is a fragmentary view of the applicator device shown in FIG. 1.

With reference to FIG. 2, it can be seen that the core 10 has a bristle-carrying portion 12 which carries bristles 11, said bristles being held by being clamped between the twisted-together strands of the core 10, and extending substantially radially from the core 10 in conventional manner.

In the example described, the bristle-carrying portion 12 of the core 10 has a longitudinal axis Y which is rectilinear and which forms, at least at its rod end 12*a*, an angle $\propto$ relative to the longitudinal axis X. In FIG. 2, the envelope E, defined by the free ends of the bristles 11 of the brush 5, is represented by a dashed line.

In FIG. 1, it should be observed that the brush 5 cannot come into contact with the wall of the receptacle 2 when the applicator is in place. Naturally, it is not beyond the ambit of the present invention for the receptacle 2 to have dimensions such that the brush 5 comes into contact with its wall. In the example described, the core 10 carries bristles 11 over substantially the entire length of its portion which extends beyond the rod 4. The bristle-carrying portion 12 presents a distal end 13 which extends from the middle M of its length to the free end of the brush. In the example described, the angle $\alpha$ is sufficiently small, e.g. being about 8°, for the axis X to intersect the envelope of said distal end 13 at a point A.

The distance d between the axis X and the axis Y at the free end 12*b* of the brush is less than about 4.5 mm for example, e.g. being close to about 3 mm. Naturally, the distance d depends on the length of the brush and may be greater than 4.5 mm without going beyond the ambit of the present invention. The distance d' from the middle M of the bristle-carrying portion 12 to the axis X is less than the distance d. The longitudinal axis Y of the bristle-carrying portion 12 extends entirely on the same side of a plane R containing the axis X and perpendicular to the plane of FIG. 2, the axis Y extending in the plane of said figure.

Figure 3:
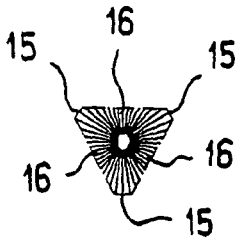
FIG. 3 is a cross-sectional view taken along line III-III of FIG. 2 according to one embodiment.

As can be seen in FIG. 3, the envelope surface E of the brush may present, at least one point along its length, a cross-section which is non-circular, said cross-section being prismatic, for example, in the example described. More particularly, in this example, the brush is of substantially triangular cross-section defining three longitudinal ridges 15 and three substantially plane faces 16 extending between the ridges. In general, the brush may have a cross-section that may or may not be constant over most of its length, or even over all of its length.

In the example in FIGS. 1 and 2, the cross-section of the brush decreases in size while remaining substantially the same shape going towards its free end, conserving a triangular shape. The ridges 15 are substantially circumscribed by a conical surface of axis Y.

In order to make the brush 5, it is possible, for example, to start with a blank having an envelope that is circularly cylindrical about the axis Y of the core, the blank being rectilinear and in alignment on the longitudinal axis X of the rod 4, then the brush 5 is machined so as to impart a conical shape thereto converging towards its free end, and three faces 16 are cut. Initially, the core 10 is bent where it leaves the rod 4 so as to impart the desired inclination a thereto.

According to one or more embodiments, the device can be used to apply makeup, wherein the user unscrews the applicator and removes the brush 5 from the receptacle 2, said brush being wiped as it passes through the wiper member 7. Given the small value of angle $\propto$, which according to some embodiments is less than about 10°, the user can use the applicator 3 without first having to identify the orientation of the core 10 about the axis X prior to applying the substance and combing the eyelashes.

Where necessary, the user can turn the brush 5 a little about the axis X. While applying makeup, the ridges 15 can act like a comb to separate the eyelashes which might have become stuck together in certain places with an excess of substance. This combing effect can be facilitated, in particular when the circumferential dimension of the ridges 15 is not greater than about 2 mm, for example. The inclination $\alpha$ of the core enables the edges of the brush to change direction progressively as it turns about the axis X of the rod, thereby improving the combing and the curling of the eyelashes, enabling the bristles of the brush to penetrate more effectively between the eyelashes.

Figure 4:
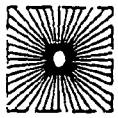
FIG. 4 is a cross-sectional view taken along line III-III of FIG. 2 according to an alternate embodiment.
Figure 5:
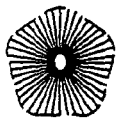
FIG. 5 is a cross-sectional view taken along line III-III of FIG. 2 according to an alternate embodiment.
Figure 6:
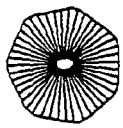
FIG. 6 is a cross-sectional view taken along line III-III of FIG. 2 according to an alternate embodiment.

Naturally, various modifications can be made to the applicator and, in particular, to the brush without going beyond the ambit of the present invention. It is possible, in particular, for the brush to have various cross-sections, e.g. square as shown in FIG. 4, or pentagonal or hexagonal as shown in FIGS. 5 and 6 respectively.

Figure 7:
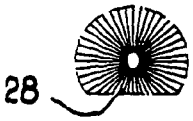
FIG. 7 is a cross-sectional view taken along line III-III of FIG. 2 according to an alternate embodiment.
Figure 8:
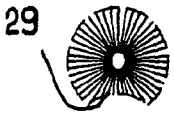
FIG. 8 is a cross-sectional view taken along line III-III of FIG. 2 according to an alternate embodiment.
Figure 9:
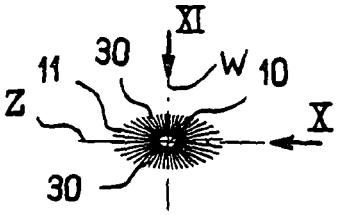
FIG. 9 is a cross-sectional view taken along line III-III of FIG. 2 according to an alternate embodiment.
Figure 10:
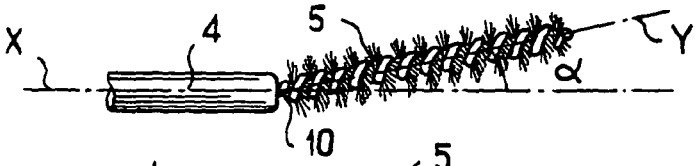
FIG. 10 is a first fragmentary perspective view, as seen along one direction represented by arrow X of FIG. 9, showing an applicator having a brush that presents the section shown in FIG. 9.
Figure 11:
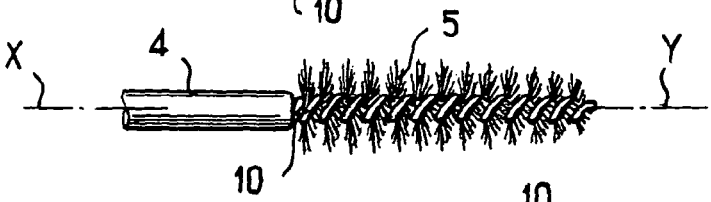
FIG. 11 is a second fragmentary perspective view as seen along a second direction perpendicular to the direction shown in FIG. 10 represented by arrow XI of FIG. 9.

By way of example, the brush may also have an envelope surface of circular cross-section with at least one flat surface 28 as shown in FIG. 7, with at least one concave side 29 as shown in FIG. 8, or with at least one convex side 30 as shown in FIG. 9. In FIG. 9, it can be seen that the brush may present an envelope surface of oblong cross-section, in particular its section may be lenticular with a major axis Z and a minor axis W. FIGS. 10 and 11 show a brush 5 having an envelope surface of lenticular cross-section observed along the major axis Z in FIG. 10 and along the minor axis W in FIG. 11.

Figure 12:
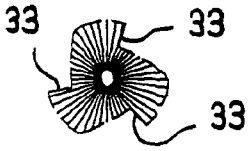
FIG. 12 shows a cross-sectional view taken along line III-III of FIG. 2 according to an alternate embodiment.
Figure 13:
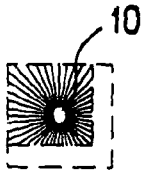
FIG. 13 shows a cross-sectional view taken along line III-III of FIG. 2 according to an alternate embodiment.

Naturally, the core could be bent in some other way without going beyond the ambit of the present invention, and in particular, the core could be bent about an axis perpendicular to the longitudinal axis X, which perpendicular axis could present any orientation about said longitudinal axis X. The brush may also have an envelope surface of a cross-section that forms notches 33, as shown in FIG. 12. The core 10 may also be off-center relative to the cross-section of the envelope surface, along at least one point of the brush, as shown in FIG. 13.

Figure 14:
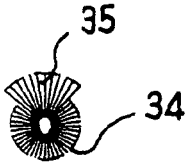
FIG. 14 shows a cross-sectional view taken along line III-III of FIG. 2 according to an alternate embodiment.

As shown in FIG. 14, the brush may also have an envelope surface with a generally keyhole-shaped cross-section, including short bristles 34 over most of its circumference and long bristles 35 over the remainder of its circumference, for example. Such a brush also forms notches.

Figure 15:
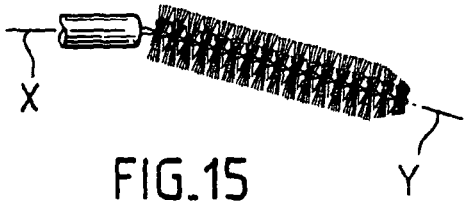
FIG. 15 is a fragmentary side view of an applicator having a brush having an envelope that has a constant cross-section over a portion of its length.

It is not beyond the ambit of the present invention when the envelope surface is of substantially constant cross-section over most of the length of the bristle-carrying portion 12 of the core, as shown in FIG. 15. It is possible to use any type of bristle in a brush made in accordance with the invention, and in particular bristles presenting a cross-section other than circular. In particular, it is possible to use a mixture of different types of bristles, or a mixture of different lengths of bristle, which may or may not be of the same type.

Figure 16:
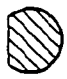
FIGS. 16 to 33 show views of various bristles according to alternate embodiments.
Figure 17:
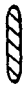
Figure 18:
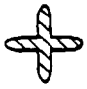
Figure 19:
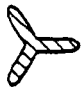
Figure 20:
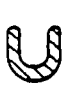
Figure 21:
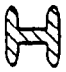
Figure 22:
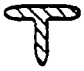
Figure 23:
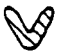
Figure 24:
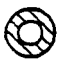
Figure 25:
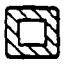
Figure 26:
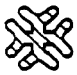
Figure 27:
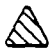
Figure 28:
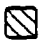
Figure 29:
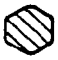
Figure 30:
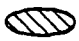
Figure 31:
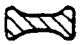
Figure 32:
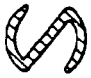
Figure 33:
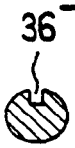

In particular, it is possible to use bristles having, in cross-section, one of the shapes shown diagrammatically in FIGS. 16 to 33, e.g. a circular shape with a flat as shown in FIG. 16, a flat shape as shown in FIG. 17, a star shape, e.g. in the shape of a cross as shown in FIG. 18, or having three branches as shown in FIG. 19, a U-shape as shown in FIG. 20, an H-shape as shown in FIG. 21, a T-shape as shown in FIG. 22, a V-shape as shown in FIG. 23, a hollow shape, e.g. circular as shown in FIG. 24, or square as shown in FIG. 25, a shape forming ramifications, e.g. snowflake-shaped as shown in FIG. 26, a prismatic section, e.g. triangular as shown in FIG. 27, or square as shown in FIG. 28, or hexagonal as shown in FIG. 29, or an oblong shape, in particular a lenticular shape as shown in FIG. 30, or hourglass-shaped as shown in FIG. 31. It is possible to use bristles having hinged-together portions as shown in FIG. 32. It is also possible to use bristles having at least one capillary groove 36, as shown in FIG. 33.

Figure 34:
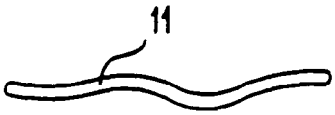
FIG. 34 is a side view of an undulating bristle according to one embodiment.
Figure 35:
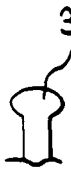
FIGS. 35 to 38 are fragmentary side views of examples of bristles according to alternate embodiments.
Figure 36:
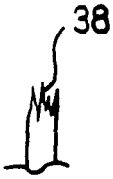

Before being put in place between the strands of the core, the bristles 11 which are retained between the twisted-together strands of the core may have a rectilinear shape, or may alternatively have a non-rectilinear shape, e.g. an undulating shape as shown in FIG. 34. The bristles may be subjected to a treatment seeking to form, at their ends, beads 37 as shown in FIG. 35, or forks 38 as shown in FIG. 36.

Figure 37:
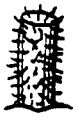
Figure 38:
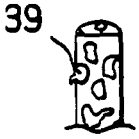

It is possible to use flocked bristles as shown in FIG. 37, or even bristles made by extruding a plastics material containing particles 39, e.g. particles of a material that absorbs moisture so as to impart microrelief to the surface of the bristles as shown in FIG. 38, or so as to give them magnetic or other properties. The bristles may also be made of a material presenting properties that facilitate sliding. The bristles may be natural or synthetic and may, for example, be manufactured out of a material selected from: PE, PA, in particular PA6, PA6/6, PA6/10, or PA6/12, HYTREL®-PEBAX®, silicone, PU, this list not being limiting. The strands of the core may be twisted to the left or to the right.

Figure 39:
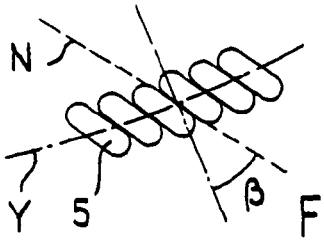
FIGS. 39 and 40 show partial side views of twisted cores having left-hand and right-hand pitches respectively.
Figure 40:
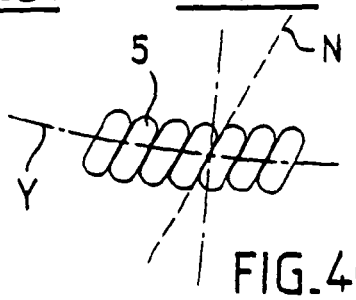

According to certain embodiments, it is particularly advantageous to use a brush having left-hand pitch as explained below with reference to FIGS. 39 and 40. FIG. 39 shows the brush 5 with a twisted core having left-hand pitch, and FIG. 40 shows a twisted core having right-hand pitch. Chain-dotted lines show the paths of the sheets N defined by the ends of the bristles, said sheets making an angle β relative to a plane perpendicular to the core. Reference can usefully be made to European patent EP 611 170.

Figure 41:
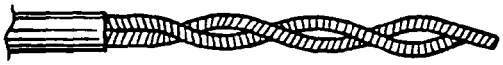
FIG. 41 is a partial side view of a double core formed by twisting together two component twisted cores.

The core may also be a double core formed by twisting together two already twisted-together component cores, as shown in FIG. 41. Each component core may comprise two strands that are twisted together and hold bristles. The two component cores may each be constituted by respective branches of a component twisted core folded into a U-shape, with the two branches then being twisted together. Naturally, the invention is not limited to the embodiments described above. In the example shown in FIG. 2, the bristle-carrying portion 12 of the core is rectilinear, but it is not beyond the ambit of the present invention for the core to be slightly curved. In addition, in the FIG. 2 example, the free end of the bristle-carrying portion 12 of the core constitutes the furthest point of said portion from the axis X, but this does not have to be the case. The brush may include one or a plurality of notches possibly forming concave facets.

Throughout the description, including the claims, the term "comprising a" should be understood as being synonymous with "comprising at least one", unless specified to the contrary.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for applying a substance onto keratinous fibers, eyelashes or eyebrows, the device comprising:

a rod having an end portion having a first longitudinal axis;

a brush fixed to said end portion of said rod, said brush including:

a twisted-wire core that is rectilinear and fixed to said end portion of said rod, said core having a bristle-carrying portion and a remote end, wherein the bristle carrying portion presents a second longitudinal axis extending into a plane containing the first longitudinal axis; and a plurality of bristles extending from said bristle-carrying portion of said twisted-wire core, said twisted-wire core being bent such that substantially all points of said bristle-carrying portion form an angle between 1° and about 15° relative to said longitudinal axis of said end portion of said rod, the brush having an envelope surface cross-section of oblong shape with a major axis perpendicular to the plane, or the brush presenting at least one face or facet that is perpendicular to the plane; and a receptacle adapted to receive said rod and said brush in an assembled condition, said receptacle having an inner wall and a wiper member, said rod and said brush being spaced from said inner wall in said assembled condition, said wiper member being disposed in said receptacle such that said wiper member wipes said brush as said brush is withdrawn from said receptacle.

2. The device according to claim 1, wherein said bristle-carrying portion is substantially rectilinear.

3. The device according to claim 1, wherein said bristle-carrying portion includes a middle and a distal end portion extending from said middle to a free end of said bristle-carrying portion, said longitudinal axis of said end portion of said rod intersecting said envelope surface of said distal end portion.

4. The device according to claim 1, wherein said bristle-carrying portion forms an angle greater than 1° and less than about 10° relative to said longitudinal axis of said end portion of said rod.

5. The device according to claim 1, wherein said bristle-carrying portion forms an angle of between 5° and about 10° relative to said longitudinal axis of said end portion of said rod.

6. The device according to claim 1, wherein said remote end of said core is situated at a distance from said longitudinal axis of said end portion of said rod of less than about 7.5 mm.

7. The device according to claim 1, wherein said remote end of said core is situated at a distance from said longitudinal axis of said end portion of said rod of less than about 4.5 mm.

8. The device according to claim 1, wherein said brush includes at least one longitudinal ridge.

9. The device according to claim 8, wherein said brush includes between two and eight of said longitudinal ridges.

10. The device according to claim 1, wherein said brush includes at least one planar or concave face.

11. The device according to claim 1, wherein a cross-section of said brush includes at least one convex surface having a radius of curvature greater than a length of a longest bristle extending from said core in said bristle-carrying portion.

12. The device according to claim 1, wherein said core includes at least two twisted-together strands.

13. The device according to claim 12, wherein said at least two strands are twisted together with a left-hand pitch.

14. The device according to claim 12, wherein said at least two strands are twisted together with a right-hand pitch.

15. The device according to claim 1, wherein said cross-section of said envelope surface is constant over a majority of said bristle-carrying portion of said core.

16. The device according to claim 1, wherein said cross-section in at least a portion of said envelope surface differs from said cross-section in a remainder of said envelope surface.

17. The device according to claim 1, wherein said cross-section in at least a portion of said envelope surface differs in size from said cross-section in a remainder of said envelope surface.

18. The device according to claim 1, wherein said cross-section of said envelope surface at at least one point along said core has a general shape selected from the group consisting of polygonal, triangular, square, pentagonal, hexagonal, oblong, oval, lenticular, star-shaped, star-shaped with three to six branches and keyhole-shaped.

19. The device according to claim 1, wherein said core defines the center of symmetry for at least one cross-section of said envelope surface.

20. The device according to claim 1, wherein said core is off-center from said envelope surface at at least one point along said bristle carrying portion.

21. The device according to claim 1, wherein said brush includes at least two sets of bristles of different diameters.

22. The device according to claim 1, wherein said bristles are made of a resilient material.

23. The device according to claim 1, wherein said bristles include a compound making it easier to slide over keratinous fibers.

24. The device according to claim 23, wherein said compound is a particulate compound.

25. The device according to claim 1, further including a handle, wherein said rod is connected to said handle.

26. The device according to claim 25, wherein said receptacle has an open end, and said handle is arranged to close said open end of said receptacle in a sealed manner in said assembled condition.

27. The device according to claim 1, wherein said twisted core of said bristle-carrying portion lies entirely on one side of a plane containing said longitudinal axis of said end portion of said rod.

28. The device according to claim 1, wherein said bristle-carrying portion has a free end, said free end being further from said longitudinal axis of said end portion of said rod than any other portion of said bristle-carrying portion.

29. The device according to claim 1, wherein said wiper member has an orifice of circular cross-section.

* * * * *